United States Patent [19]

Augustine

[11] 3,947,940

[45] Apr. 6, 1976

[54] METHOD FOR MAKING CONE SPRAY NOZZLE

[76] Inventor: Frank B. Augustine, 1135 McLaughlin Road, Bridgeville, Pa. 15017

[22] Filed: May 20, 1974

[21] Appl. No.: 471,535

Related U.S. Application Data

[62] Division of Ser. No. 328,132, Jan. 30, 1973, Pat. No. 3,811,621.

[52] U.S. Cl. ..... 29/157 C; 29/525

[51] Int. Cl.[2] ..... B21D 53/00

[58] Field of Search ..... 29/157 R, 157 B, 157 C, 29/432, 432.2, 522, 428, 525; 239/458, 460, 498, 506, 518, 520, 539, 547, 550, 552

[56] References Cited

UNITED STATES PATENTS

| | | | |
|---|---|---|---|
| 978,597 | 12/1910 | Kennedy | 29/157 C |
| 1,246,456 | 11/1917 | Parpert | 29/157 C |
| 1,519,010 | 12/1924 | Reznor | 29/157 C |
| 1,880,880 | 10/1932 | Dietsch | 239/460 X |
| 2,069,150 | 1/1937 | Holder | 29/157 C |
| 2,714,244 | 8/1955 | Shepard | 29/157 C |

*Primary Examiner*—Victor A. Dipalma
*Attorney, Agent, or Firm*—Arland T. Stein; Thomas C. Wettach

[57] ABSTRACT

A cone spray nozzle is provided in a tubular member for carrying a fluid to be sprayed. The tubular member has at least one opening with a plurality of grooves, preferably symmetrical, around the periphery thereof. In each opening is positioned a dispersion member having a stem portion for fastening to the tubular member and a tapered head portion with an angular, typically conical surface for dispersing the fluid. The fluid is ejected from the tubular member through the grooves to strike the tapered head portion, which in turn disperses the fluid in a generally conical spray pattern. Preferably the nozzle is made by punching the opening having the peripheral grooves with a die and inserting the dispersion member which is preferably a standard flat-head screw or rivet.

3 Claims, 13 Drawing Figures

METHOD FOR MAKING CONE SPRAY NOZZLE

This is a division of application Ser. No. 328,132 filed Jan. 30, 1973, now U.S. Pat. No. 3,811,621.

FIELD OF THE INVENTION

The present invention relates to spray nozzles and particularly cone spray nozzles for positioning along a pipe, tube or the like.

BACKGROUND OF THE INVENTION

Spray nozzles are generally old and well-known in the art. They are applicable for a variety of purposes to disperse fluids and usually liquids. Illustrative of the art are believed to be U.S. Pat. Nos. 584,822, 1,147,018, 1,246,456, 1,264,854, 1,296,542, 1,527,222, 2,338,744, 2,570,972, 2,628,865 and 2,811,392.

A cone spray nozzle is a spray nozzle adapted to discharge a fine spray in the general shape of a cone. Cone spray nozzles have been used for dust settling, evaporative cooling, humidifying, irrigating, process cleaning and fuel injection. A good example of such nozzles is set forth in U.S. Pat. No. 2,628,865.

Cone spray nozzles in their simplest form have usually been comprised of two components: A bushing which is typically threaded into a tube or pipe, and a dispersing member having a stem and a conical head portion which is fastened into the opening in the bushing. Corrugations or grooves are usually provided along the stem of the dispersion member so that the fluid jets from tube or pipe to strike the conical surface, which in turn disperses the fluid in the cone-like spray. In some cases, the grooves may be formed in the conical surface of the head portion of dispersion member to localize and further atomize the spray pattern.

Alternatively, the cone nozzle may be made in one component. A head member is provided having a single jet-like opening therein and an internal chamber with spiral grooves terminating in the opening. The fluid to be sprayed is forced into the internal chamber of the head and caused to undergo vortex flow by the spiral grooves. The fluid is thus forced through the jet-like opening in an atomized conical spray pattern.

However, irrespective of their construction, cone spray nozzles have been relatively expensive to manufacture. Precision machining is needed to make the bushing and dispersion member, or the internally grooved head. Thus, it was not uncommon for cone spray nozzles to be priced at greater than $1.00 apiece and greater than $0.50 each in quantities.

SUMMARY OF THE INVENTION

The present invention provides an inexpensive cone spray nozzle at a cost substantially less than previous cone spray nozzles. It eliminates or substantially reduces the machining needed to make such cone spray nozzles. It eliminates entirely the need for a bushing member or an internally grooved head to make a cone spray nozzle. In addition, it enables the installation of any desired number of cone spray nozzles at any desired spacing and in a wide range of sizes.

The cone spray nozzle of the present invention comprises a tubular member such as a pipe or conduit adapted for carrying a fluid to be sprayed. One or more openings are provided in the tubular member, with each opening having a plurality of grooves provided around the periphery of each opening preferably symmetrically. In each opening is positioned a dispersion member having a stem portion for fastening the member to the tubular member and a tapered head portion with an angular surface for dispersing fluid ejected through the grooves.

The dispersion member is preferably a flat-head screw or rivet which is inserted into the opening. A cone spray nozzle can thus be provided at essentially the cost of the screw or rivet which are standard articles of commerce. Only the initial outlay for the punching die to form the grooved opening and the labor cost to form the opening is additional.

Preferably the cone spray nozzle is made simply by cutting a desired length of tubular member such as pipe or tubes and placing it in a punching die where the openings having the grooves around the periphery are punched at the desired locations. The dispersion members are then simply pressed or threaded into the openings either before or after installation of the tubular member in the desired application. In a preferred technique the opening is formed and the dispersion member pressed into the opening before installation of the tubular member.

Other details, objects and advantages of the invention will become apparent as the following description of the present preferred embodiments and present preferred methods of practicing the same proceeds.

BRIEF DESCRIPTION OF THE DRAWINGS

In the accompanying drawings, the present preferred embodiments of the invention and present preferred methods of practicing the invention are illustrated in which.

DESCRIPTION OF THE PREFERRED EMBODIMENTS

Referring to FIGS. 1–4, two cone spray nozzles 10 and 10' are provided in tubular member 11 adapted for carrying a fluid to be sprayed. Tubular member 11 is preferably a standard pipe or tube sized and shaped to the particular application to facilitate formation of the cone spray nozzles.

Figure 1:
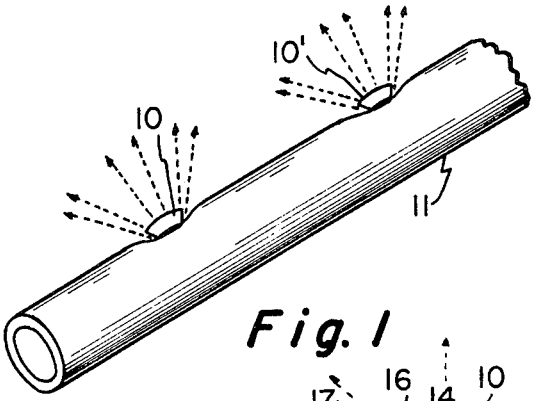
FIG. 1 is a perspective view of a cone spray nozzle system of the present invention.
Figure 2:
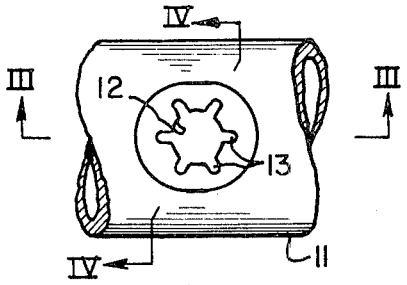
FIG. 2 is a fragmentary elevational view of the cone spray nozzle system of FIG. 1.

Each cone spray nozzle 10 is provided by forming an opening 12 in the tubular member. Opening 12 has a plurality of grooves 13 formed around the periphery of the opening. As shown by FIG. 2, six grooves are symmetrically positioned around the periphery. More or less grooves, e.g. four or eight, may be positioned around the periphery of the opening, either symmetrically or asymmetrically, as the size of the opening and the grooves and the desired spray pattern may require. Grooves 13 may be as deep and as wide as the desired spray pattern may require: Typically the grooves are finer and shallower and greater in number as the desired spray pattern becomes finer. Further the grooves preferably are disposed symmetrically around the periphery to provide a uniform spray pattern.

Figure 3:
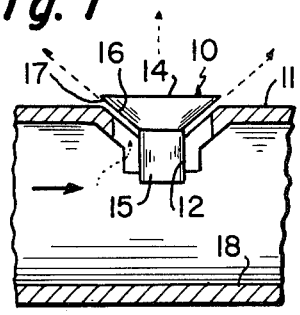
FIG. 3 is an elevational cross-sectional view taken along line III—III of FIG. 2.
Figure 4:
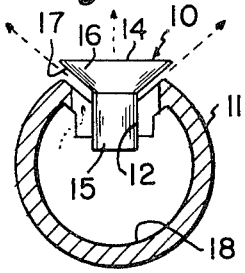
FIG. 4 is a cross-sectional view taken along line IV—IV of FIG. 2.

Positioned in opening 12 is dispersion member 14 having stem portion 15 and tapered head portion 16. Preferably dispersion member 14 may be a flat-head rivet as shown in FIG. 3. In this embodiment, the dispersion member is positioned in the opening by pressing stem portion into position in the opening to fasten it to tubular member 11 as described hereinafter. Tapered head portion 16 has angular surface 17, which is shaped preferably conically, to provide for a generally conical spray pattern from the nozzle.

Figure 5:
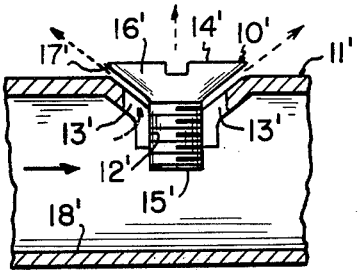
FIG. 5 is an elevational cross-sectional view of an alternative cone spray nozzle system of the present invention.

Referring to FIG. 5, an alternative cone spray nozzle of the present invention is shown. The components and variations are the same as previously described in connection with FIGS. 1–4 except for the dispersion member. Dispersion member 14' is a fully threaded flat-head machine screw which is threaded into opening 12'.

Figure 6:
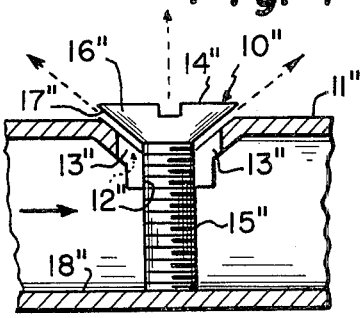
FIG. 6 is an elevational cross-sectional view of a second alternative cone spray nozzle system of the present invention.

Referring to FIG. 6, a second alternative cone spray nozzle of the present invention is shown. Again the components and variations are the same as previously described in connection with FIGS. 1–4 except for the dispersion member. As in FIG. 5, the dispersion member 14'' is a fully threaded flat-head machine screw, but the stem portion 15'' extends to the opposite inside surface 18'' of the tubular member. This permits the dispersion member to be readily positioned to provide the desired spray pattern when threaded into opening 12''.

Irrespective of the fore-described embodiment, the operation is substantially the same. A fluid such as water flows under pressure through the tubular member 11 from one end, and is ejected through grooves 13 around the stem portion 15 of the dispersion member 14. The fluid strikes the tapered head portion 16 at the angular surface 17 which is typically conical in shape. The fluid is thus forced radially outwardly at a predetermined rate as shown by the arrows on FIGS. 5 and 6. This action occurs around the periphery of the opening at each groove 13 to provide the desired cone-like spray pattern.

Figure 7:
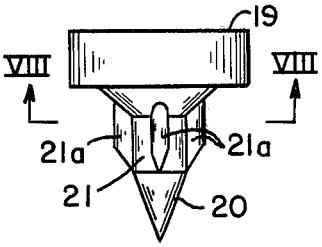
FIG. 7 is an elevational view of a die tool suitable for punching an opening to make a cone spray nozzle system of the present invention.
Figure 8:
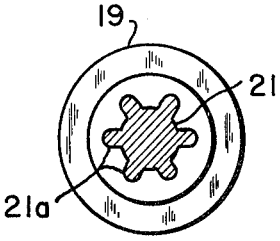
FIG. 8 is a cross-sectional view taken along line VIII—VIII of FIG. 7.

The cone spray nozzle can, of course, be made by drilling openings 12 and machining grooves 13. Preferably, however, tubular member 11 is a relatively thin-walled member which can be punched with a die tool 19 as shown in FIGS. 7 and 8. Die tool 19 has lead edge portions 20 suitable to punch into the tubular member under the pressure of a conventional small hand press, or mechanical or hydraulic press (not shown). The shaping portion 21 of tool 19 is of a cross-section desired for the openings 12 with protrusions 21A to form the grooves 13 around the periphery of opening 12.

Figure 9:
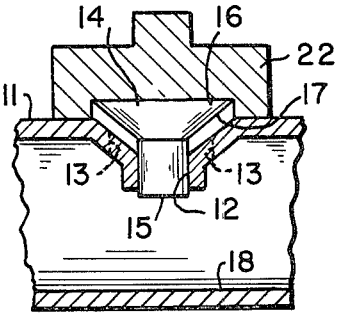
FIG. 9 is a schematic showing the pressing of a dispersion member into an opening to make a cone spray nozzle of the present invention.

Thereafter dispersion member 14 can be positioned at the same time with the same small press. The die tool 19 is removed and press head 22 as shown in FIG. 9 is positioned in the press. A flat-head rivet is then positioned in press head 22, which is appropriately shaped, and pressed into the opening 12 as shown in FIG. 9.

The cone spray nozzle of the present invention can obviously be applied in a variety of applications. It is also readily apparent that a wide range of flexibility is provided. The nozzles can be variously spaced and sized from specification to specification. Further, the nozzles can be readily fitted or retrofitted in the field.

To illustrate some of the applications for the present nozzle system, reference is made to FIGS. 10 through 13.

Figure 10:
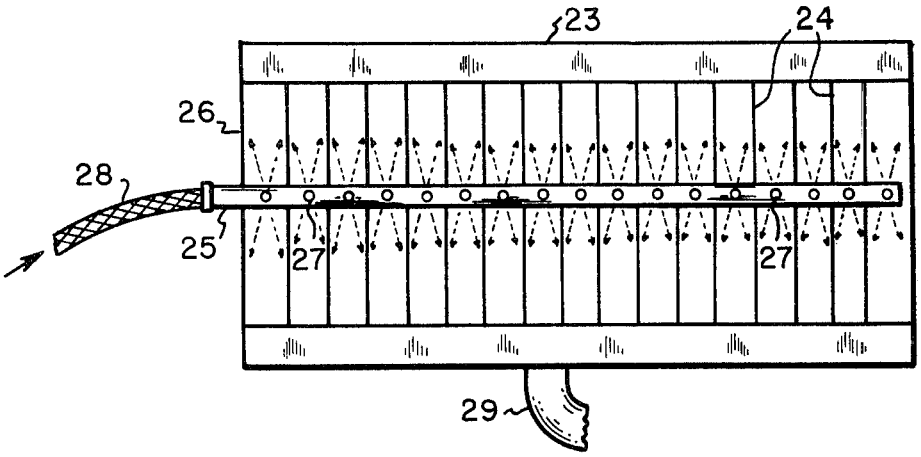
FIG. 10 is an elevational view in cross-section of an electrostatic air cleaner including a cone spray nozzle system of the present invention to automatically clean the electrostatic plates.

Specifically, FIG. 10 shows an electrostatic air cleaner incorporating the present invention. Air or gas to be cleaned is forced through the enclosure 23 of the unit between parallel, spaced apart plates 24, which are charged with an electric potential. The participant matter in the air is attracted by the electric potential to plates 24 where it is held. The air, minus the participant matter, thereafter exits from the unit.

A manifold 25 is provided through the side 26 of enclosure 23 and through plates 24. The nozzles 27 of the present invention are provided in manifold 25 between each pair of spaced apart plates 24. Manifold 25 is connected by hose 28 to a cleaning fluid supply (not shown). Thus, the air cleaner can be automatically cleaned from time to time simply by stopping the operation and running water or some other cleaning fluid into manifold 25 to spray plates 24 through nozzles 27 as shown by the arrows in FIG. 10. The participant matter trapped on plates 24 is carried away with the water through sump 29.

Figure 11:
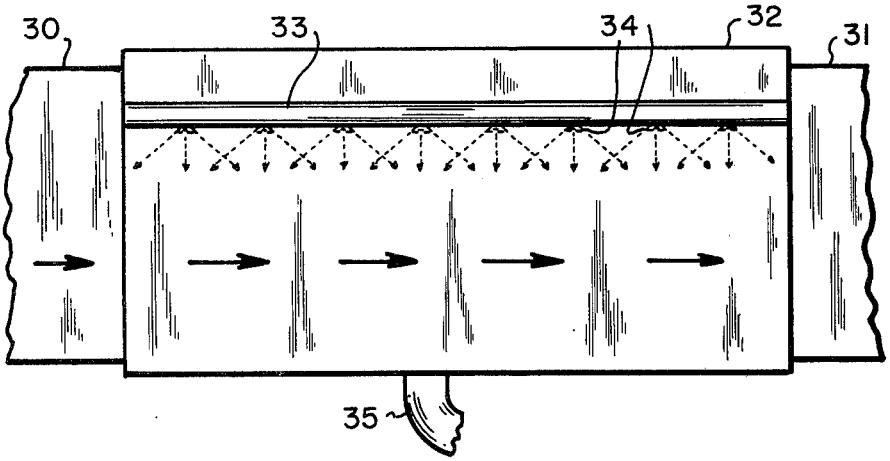
FIG. 11 is an elevational view in cross-section of a gas cleaner or humidifier utilizing a cone spray nozzle system of the present invention.

Referring to FIG. 11, the cone spray nozzles of the present invention are shown incorporated into a humidifier. Dry air is passed by ducts 30 and 31 through enclosure 32 of the humidifier. In the upper portion of enclosure 32 is positioned a manifold or tubular member 33 with nozzles 34 of the present invention therein. Nozzles 34 are designed so that they spray a fine atomized mist of water into the dry air as it passes through the enclosure as shown by the arrows in FIG. 11. Thus, the exiting air is provided with moisture in a desired amount. The humidity of the exiting air can be controlled by the flow rates of the dry air into the enclosure and the water into the manifold. A sump 35 is provided in the base of enclosure 32 to remove any excess water sprayed into the enclosure.

Figure 12:
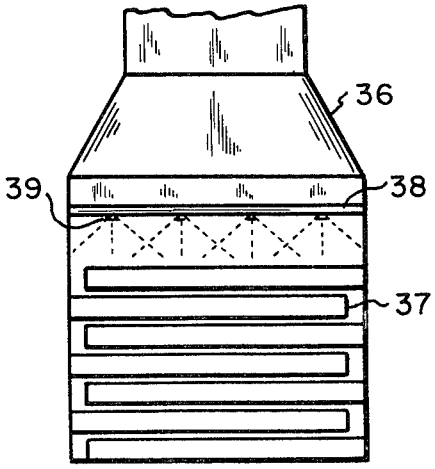
FIG. 12 is an elevational view in cross-section of a cooling tower utilizing a cone spray nozzle system of the present invention.

Referring to FIG. 12, the cone spray nozzles of the present invention are shown incorporated into a cooling tower. Air or other gas to be cooled flows into the tower through duct 36 and around and between baffles and cooling coils 37 where the gas is cooled. To further cool the air and keep the baffles or coils 37 free of participant matter, water or the like is sprayed over and around the coils 37. To do this, manifold 38 is provided at the upper portion of the tower above the baffles or coils with cone spray nozzles 39 of the present invention therein. The water to clean the baffles or coils 37 is thus sprayed from manifold 38 as shown by the arrows in FIG. 12.

Figure 13:
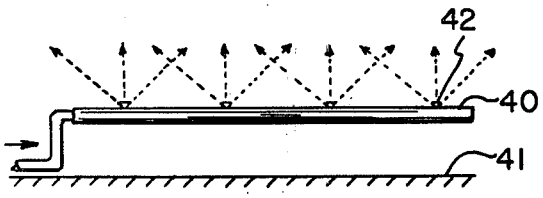
FIG. 13 is an elevational view in cross-section of a rooftop cooler or dust collector.

Referring to FIG. 13, the cone spray nozzles of the present invention are shown in a roof dust collector and cooler. A series of tubes or pipes 40 are positioned over roof 41 spaced from it. In pipes 40 are provided nozzles 42 positioned to spray water or the like upward as shown by the arrows in FIG. 13 to form a fine mist in the air over the roof. The mist collects the participant matter in the air and falls to roof 41 where it drains off and simultaneously cools the roof.

The present invention has application in a variety of other uses. For example, the present invention may be adapted to automatic autowashes and greenhouse irrigation systems. While presently preferred embodiments have been shown and described with particularity, it is distinctly understood that the invention may be otherwise variously embodied and performed within the scope of the following claims.

What is claimed is:

1. A method of making a cone spray nozzle comprising the steps of:

A. punching an opening having a plurality of grooves around the periphery thereof through a tubular member; and B. positioning a dispersion member in said opening having a stem portion engaging said periphery of said opening for fastening said dispersion member to the tubular member and having a tapered head portion to disperse fluid ejected from the tubular member through the grooves in a spray pattern by striking the tapered head portion.

2. A method of making a cone spray nozzle as set forth in claim 1 wherein:

the dispersion member is pressed into the opening.

3. A method of making a cone spray nozzle as set forth in claim 1 wherein:

the dispersion member is threaded into the opening.

* * * * *